US011377186B1

(12) United States Patent
Ahlswede et al.

(10) Patent No.: US 11,377,186 B1
(45) Date of Patent: Jul. 5, 2022

(54) APPARATUSES AND DEVICES FOR OPERABLY CONNECTING A MARINE DRIVE TO A MARINE VESSEL

(71) Applicant: Brunswick Corporation, Mettawa, IL (US)

(72) Inventors: Scott G. Ahlswede, Plymouth, WI (US); Jeffrey A. Zarembka, Plymouth, WI (US); John D. Skroski, Oshkosh, WI (US); Brad J. VanRuiswyk, Waupun, WI (US)

(73) Assignee: Brunswick Corporation, Mettawa, IL (US)

( * ) Notice: Subject to any disclaimer, the term of this patent is extended or adjusted under 35 U.S.C. 154(b) by 72 days.

(21) Appl. No.: 16/985,331

(22) Filed: Aug. 5, 2020

(51) Int. Cl.

| | |
|---|---|
| ***B63H 20/06*** | (2006.01) |
| ***B63H 20/00*** | (2006.01) |
| ***B63H 20/10*** | (2006.01) |
| ***B63H 20/12*** | (2006.01) |

(52) U.S. Cl.
CPC ..... *B63H 20/06* (2013.01); *B63H 20/001* (2013.01); *B63H 20/10* (2013.01); *B63H 20/12* (2013.01)

(58) Field of Classification Search
CPC ..... B63H 20/06; B63H 20/001; B63H 20/10; B63H 20/12
See application file for complete search history.

(56) References Cited

U.S. PATENT DOCUMENTS

| | | | | |
|---|---|---|---|---|
| 4,969,847 | A | 11/1990 | Curtis et al. | |
| 5,078,629 | A * | 1/1992 | Mondek | F02B 61/045 123/195 C |
| 6,257,940 | B1 | 7/2001 | Dunham et al. | |
| 6,960,108 | B1 | 11/2005 | Jaszewski et al. | |
| 7,104,856 | B1 | 9/2006 | Krupp et al. | |
| 8,858,280 | B1 | 10/2014 | Wiegele et al. | |
| 9,944,375 | B1 | 4/2018 | Martin et al. | |
| 9,969,475 | B1 | 5/2018 | Waisanen | |
| 10,017,136 | B1 | 6/2018 | Waisanen et al. | |
| 10,202,180 | B1 | 2/2019 | Amerling et al. | |
| 10,259,554 | B1 | 4/2019 | Eichinger et al. | |
| 10,286,989 | B1 | 5/2019 | Amerling et al. | |
| 2015/0048230 | A1* | 2/2015 | Satterfield | F16M 11/2035 248/278.1 |
| 2015/0140877 | A1* | 5/2015 | Shields | B63H 20/06 440/6 |
| 2019/0344871 | A1* | 11/2019 | Takase | B63H 20/12 |

* cited by examiner

*Primary Examiner* — Stephen P Avila
(74) *Attorney, Agent, or Firm* — Andrus Intellectual Property Law, LLP

(57) ABSTRACT

An apparatus is for operably connecting a marine drive to a marine vessel. A transom bracket is configured for fixed attachment to the marine vessel and for attachment to the marine drive such that the marine drive is trimmable up and down relative to the marine vessel about a trim axis. The transom bracket has a sidewall with a rigging opening through which at least one elongated rigging member extends for operably connecting the marine drive to the marine vessel, wherein the rigging opening is located along the trim axis. The rigging device has an elbow conduit with an inlet end and an outlet end, wherein the outlet end is positionable into a plurality of clock positions relative to the inlet end.

49 Claims, 8 Drawing Sheets

APPARATUSES AND DEVICES FOR OPERABLY CONNECTING A MARINE DRIVE TO A MARINE VESSEL

FIELD

The present disclosure relates to marine drives for propelling marine vessels in water, and more particularly to rigging apparatuses for marine drives, such as outboard motors.

BACKGROUND

The following U.S. Patents are incorporated herein by reference.

U.S. Pat. No. 4,969,847 discloses a strain relief assembly for an outboard motor for relieving strain on wires, cables, lines or the like which extend between the boat and the cowl assembly which encloses the power head of the outboard motor. The strain relief assembly is preferably disposed within an opening formed in one of the cowl sections, and comprises a two-piece member. The two-piece member includes a series of indentations which cooperate to clamp the wires, cables, lines or the like there between when screwed together. With the strain relief assembly fixed to the wall of the cowl section forming the opening, this acts to maintain the wires, cables or lines in position relative to the cowl section for relieving strain thereon during movement of the outboard motor. A fuel line strain relief assembly is also provided, comprising a stem fixed to the two-piece member. An external fuel line supplies fuel to the stem, which is communicated there through to an internal fuel line extending between the stem and the power head.

U.S. Pat. No. 6,960,108 discloses a protective containment device provided to serve as a strain relief component for hoses, wires, and push-pull cables extending through a front surface of an outboard motor. The protective containment device is formed from first and second portions that are assembled together with a flexibly connected divider that segregates certain components within the protective device from other components. A cylindrical ring, made of first and second retainers, is disposed around an outer surface of the cylindrical conduit to hold the first and second portions together and to retain a flexible tube in place.

U.S. Pat. No. 7,104,856 discloses a rigging apparatus provided for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

U.S. Pat. No. 9,944,375 discloses a system for controlling trim position of a marine propulsion device on a marine vessel includes a trim actuator having a first end configured to couple to the marine propulsion device and a second end configured to couple to the marine vessel. A controller controls position of the trim actuator between an extended position wherein the propulsion device is trimmed up with respect to the vessel and a retracted position wherein the propulsion device is trimmed down with respect to the vessel. A shock relief mechanism overrides position control by the controller and allows extension of the trim actuator upon the occurrence of an overpressure event. An arresting mechanism, when activated, prevents extension of the trim actuator beyond a certain limit. The controller selectively activates the arresting mechanism in response to a determination that the propulsion device is being commanded in reverse. Methods for controlling trim position are also included.

U.S. Pat. No. 9,969,475 discloses a system for mounting an outboard motor propulsion unit to a marine vessel transom including a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of an engine system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 10,017,136 discloses an outboard motor that can be coupled to a transom of a marine vessel via the described rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

U.S. Pat. No. 10,202,180 discloses an outboard motor including an engine coupled in torque-transmitting relationship with a propulsor via a driveshaft. A protective covering for the outboard motor includes a cowl that houses the engine within a closed interior thereof. An opening in an outer surface of the cowl provides access to the closed interior. A rigging tray can be inserted through the opening to a retracted position, in which a majority of the rigging tray is within the closed interior. A plurality of electrical lines extends from the engine and into the rigging tray from a first end thereof. Each electrical line in the plurality of electrical lines terminates in the rigging tray at a respective one of a plurality of electrical connectors. A second end of the rigging tray receives a complementary plurality of vessel electrical lines for connection to the plurality of engine electrical lines via the plurality of electrical connectors.

U.S. Pat. No. 10,286,989 discloses a marine drive including an engine; a cowl having first and second cowl portions. The first cowl portion is movable with respect to the second cowl portion into an open position in which the engine is manually accessible and a closed position in which the engine is enclosed; and a rigging port in the second cowl portion. The rigging port provides a passageway for rigging connectors extending from the engine to a component located remotely from the engine. A rigging window provides manual access to the rigging connectors and the engine, including when the first cowl portion is in the closed position. A removable access door covers the rigging window and prevents manual access to the engine and rigging connectors via the rigging window. The removable access door is fastened to the second cowl portion by a removable fastener that is hidden from view.

U.S. Pat. No. 10,259,554 discloses an outboard motor having an adapter plate with an upper surface supporting an engine, a lower surface spaced therefrom, and fore and aft sides connecting the upper and lower surfaces. A first pocket is defined in the adapter plate's fore side and a second pocket is defined in its aft side. A midsection housing is coupled to the adapter plate's lower surface and suspends a propulsion unit therebelow. A driveshaft coupling the engine's output shaft to the propulsion unit's propeller shaft extends through the adapter plate. A steering arm, which extends into the first pocket, has a hole through which the driveshaft extends. A mount in the second pocket is located aft of the driveshaft, and the mount's fore side is coupled to the steering arm's aft end by way of connectors. A cover plate attached to the adapter plate's aft side secures the mount within the second pocket.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples disclosed herein, an apparatus is for operably connecting a marine drive to a marine vessel. A transom bracket is configured for fixed attachment to the marine vessel and for attachment to the marine drive such that the marine drive is trimmable up and down with respect to the marine vessel about a trim axis. The transom bracket has a sidewall with a rigging opening through which at least one elongated rigging member extends for operably connecting the marine drive to the marine vessel, wherein the rigging opening is located along the trim axis.

In certain examples disclosed herein, a rigging device is for routing at least one elongated rigging member from a marine drive to a marine vessel. The rigging device has an elbow conduit with an inlet end and an outlet end, wherein the outlet end is positionable into a plurality of clock positions relative to the inlet end.

BRIEF DESCRIPTION OF THE DRAWINGS

The present disclosure is provided with reference to the following drawing Figures.

DETAILED DESCRIPTION

Figure 1:
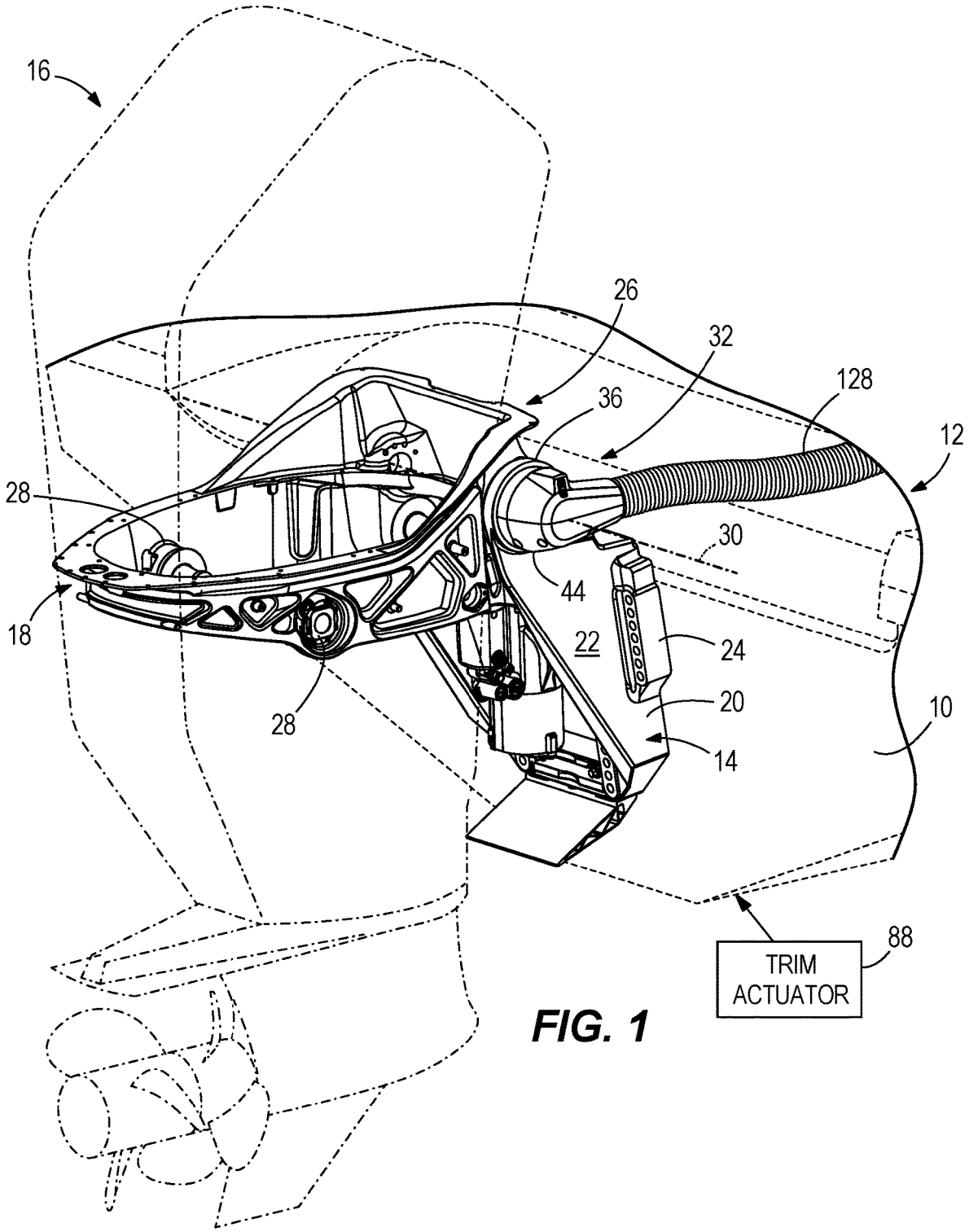
FIG. 1 is a perspective view showing an outboard motor in dash-and-dot lines and the transom of a marine vessel in dashed lines. An apparatus for coupling the outboard motor to a marine vessel is shown in solid lines and includes a supporting cradle, a transom bracket, and a rigging device configured according to the present disclosure.

FIG. 1 depicts the transom 10 of a marine vessel 12. A transom bracket 14 is fixed to the transom 10 in a conventional manner. A marine drive, which in this example is an outboard motor 16, is pivotally coupled to the transom bracket 14 via a supporting cradle 18. The type and configuration of the marine drive, transom bracket 14 and supporting cradle 18 can vary from what is shown. Examples of suitable marine drives, transom brackets and supporting cradles for use with the present invention are disclosed in the above-incorporated U.S. patents, for example especially see U.S. Pat. No. 9,969,475, among others.

The transom bracket 14 has a base portion 20 and port and starboard sidewalls 22 that extend aftwardly from the base portion 20. The base portion 20 is mounted to the transom 10 via port and starboard mounting flanges 24. FIG. 1 depicts only the starboard mounting flange 24. The supporting cradle 18 has a forward mounting portion 26 disposed between the port and starboard sidewalls 22. The supporting cradle 18 further has port and starboard resilient mounting devices 28 that couple the outboard motor 16 to the supporting cradle 18. The port and starboard resilient mounting devices 28 are configured to reduce noise, vibration and harshness of the outboard motor 16, for example dampening the transfer of vibrations of the outboard motor 16 with respect to the transom bracket 14 and marine vessel 12. Examples of suitable resilient mounting devices are provided in the presently-incorporated U.S. Pat. Nos. 9,969,475 and 10,259,554, among others.

The mounting portion 26 is pivotably coupled to the port and starboard sidewalls 22 along a trim axis 30, in particular so that the supporting cradle 18 and associated outboard motor 16 are trimmable (i.e., pivotable) up and down about the trim axis 30 relative to the transom bracket 14 and marine vessel 12. Reference is made to the presently-incorporated U.S. Patents, in particular U.S. Pat. No. 9,969,475, for further explanation of this type of pivotal connection between a supporting cradle and a transom bracket.

As further described herein below with reference to FIGS. 2-10, a novel rigging device 32 is coupled to the starboard sidewall 22 of the transom bracket 14 and configured to efficiently route a plurality of elongated rigging members 34 from the outboard motor 16 to the marine vessel 12. In other examples the rigging device 32 can be coupled to the port sidewall 22 of the transom bracket 14. The rigging members 34 are conventional items for operationally connecting the outboard motor 16 to the marine vessel 12, and often include for example electrical wires for transferring electrical signals between the outboard motor 16 and marine vessel 12, and/or fuel conduits for conveying fuel, etc., between the outboard motor 16 and marine vessel 12. Other examples of conventional rigging members are disclosed in the presently-incorporated U.S. Patents, including U.S. Pat. Nos. 10,202,180 and 10,286,989, among others.

Figure 2:
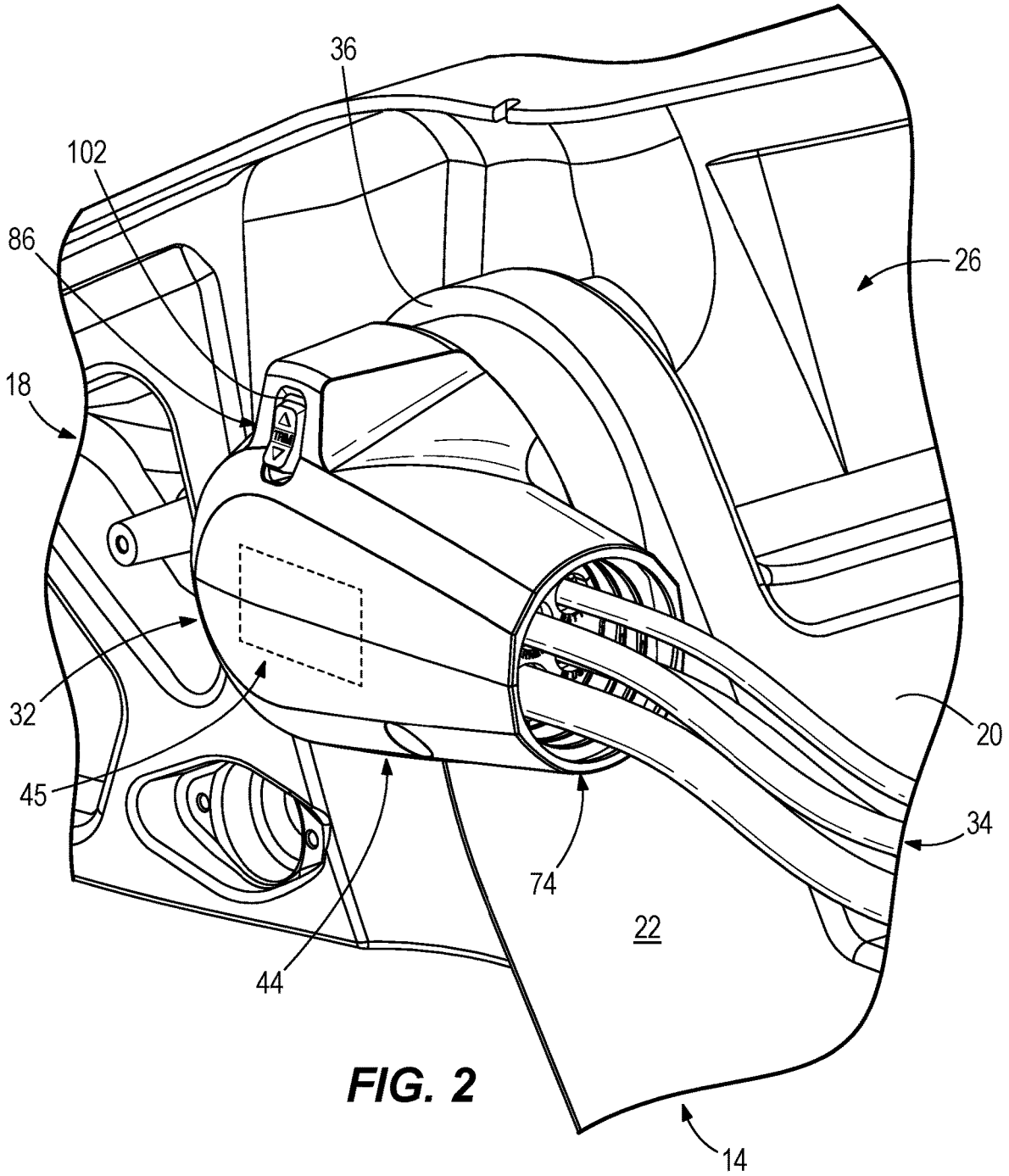
FIG. 2 is a perspective of the rigging device, showing a plurality of elongated rigging members extending from the rigging device.
Figure 3:
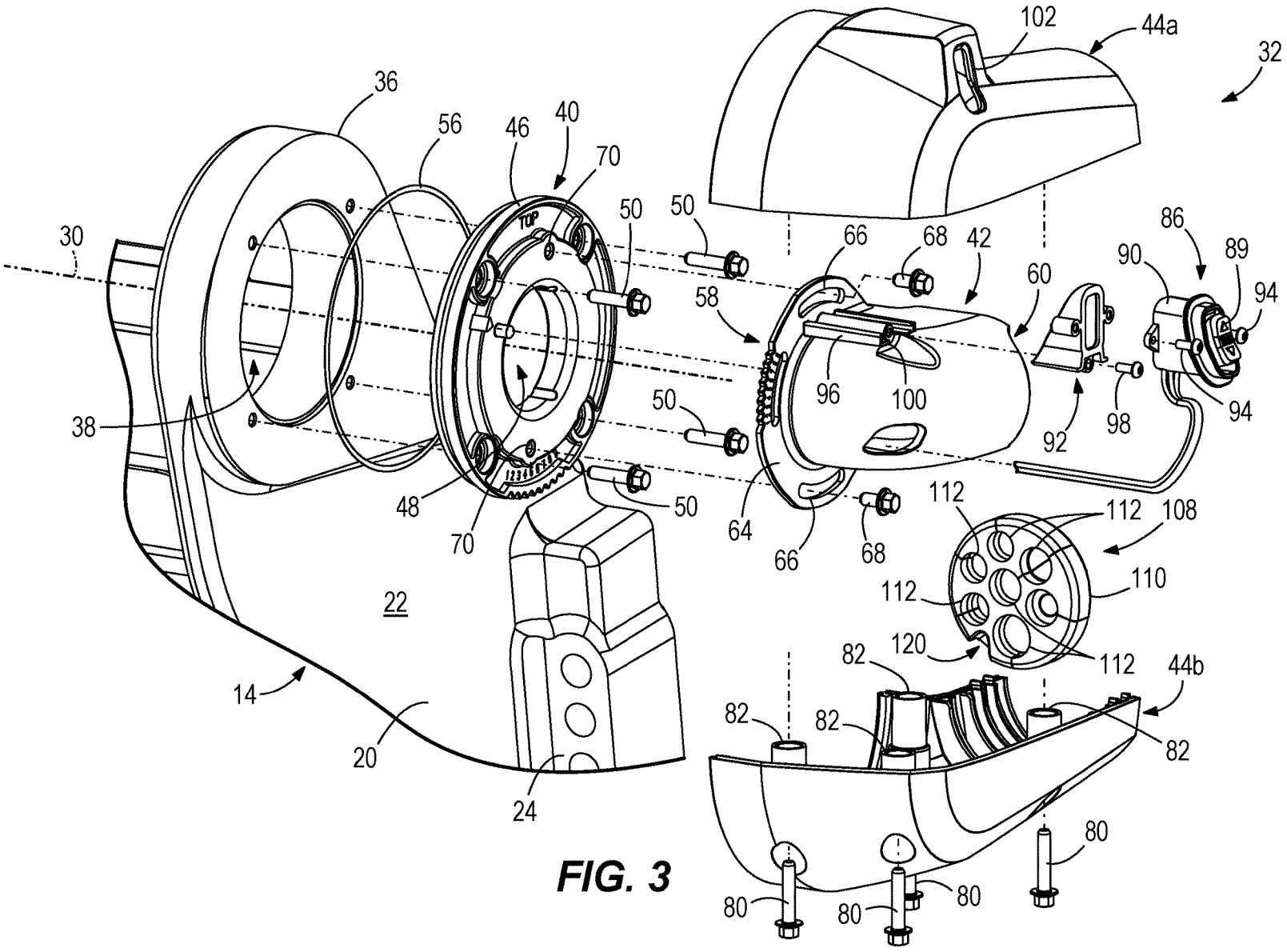
FIG. 3 is an exploded view of the rigging device and a portion of the transom bracket.

As shown in FIGS. 2 and 3, the starboard sidewall 22 of the transom bracket 14 has an upwardly extending mounting ear 36 with a circular rigging opening 38. The rigging opening 38 is coaxial and concentric with the noted trim axis 30. The rigging device 32 is mounted on the ear 36, over the rigging opening 38, and generally includes a base plate 40, an elbow conduit 42, and an elbow cover 44.

Referring to FIG. 3, the base plate 40 has a circular outer diameter 46 and a circular center opening 48 which is coaxially aligned with the rigging opening 38. Four fasteners 50 extend through corresponding holes 52 in the base plate 40 and are engaged in threaded connection with corresponding bores 54 in the ear 36, to thereby rigidly fasten the base plate 40 to the transom bracket 14. Other known means for connecting the base plate 40 to the transom bracket 14 can be used in place of or in addition to the fasteners 50. Optionally, a rubber ring seal 56 is sandwiched between the back surface of the base plate 40 and the ear 36, and provides a sealed interface that limits water ingress to the rigging device 32. Optionally, a different seal can be disposed between the base plate 40 and elbow cover 44. Other known means for providing the sealed interface can be used in place of or in addition to the rubber ring seal 56. Other seals can be provided between various components shown in FIG. 3, as would be understood by one having ordinary skill in the art.

The elbow conduit 42 has an inlet end 58, which is coaxial with and faces the rigging opening 38 and the center opening 48. The elbow conduit 42 also has an opposite outlet end 60 which is transversely oriented relative to the inlet end 58 and generally faces towards the marine vessel 12. In the illustrated example, the elbow conduit 42 defines a ninety-degree bend between the inlet end 58 and outlet end 60, so that the outlet end 60 is oriented about ninety degrees transversely to the inlet end 58. In other examples, the degree of the bend can be different than ninety-degrees. A radial flange 64 on the inlet end 58 has diametrically opposed and elongated slots 66. Fasteners 68 extend through the slots 66 and into threaded engagement with bores 70 in the base plate 40, to thereby fasten the elbow conduit 42 to the base plate 40. The fasteners 68 have radially enlarged heads which are tightened onto the top surface of the radial flange 64 alongside the slots 66 during installation when the fasteners 68 are manually tightened into the bores 70, to thereby securely fasten the elbow conduit 42 to the base plate 40. As will be further described herein below, the slots 66 facilitate repositioning or "clocking" of the elbow conduit 42 during installation, into a variety of clock positions relative to the rigging opening 38. Optionally, inserts are located in the bores 70 and have internal threads for engaging with external threads on the fasteners 68. While fasteners 68 and bores 70 are shown in the drawings, other known means could be used to couple the base plate 40 to the transom bracket 14.

Figure 4:
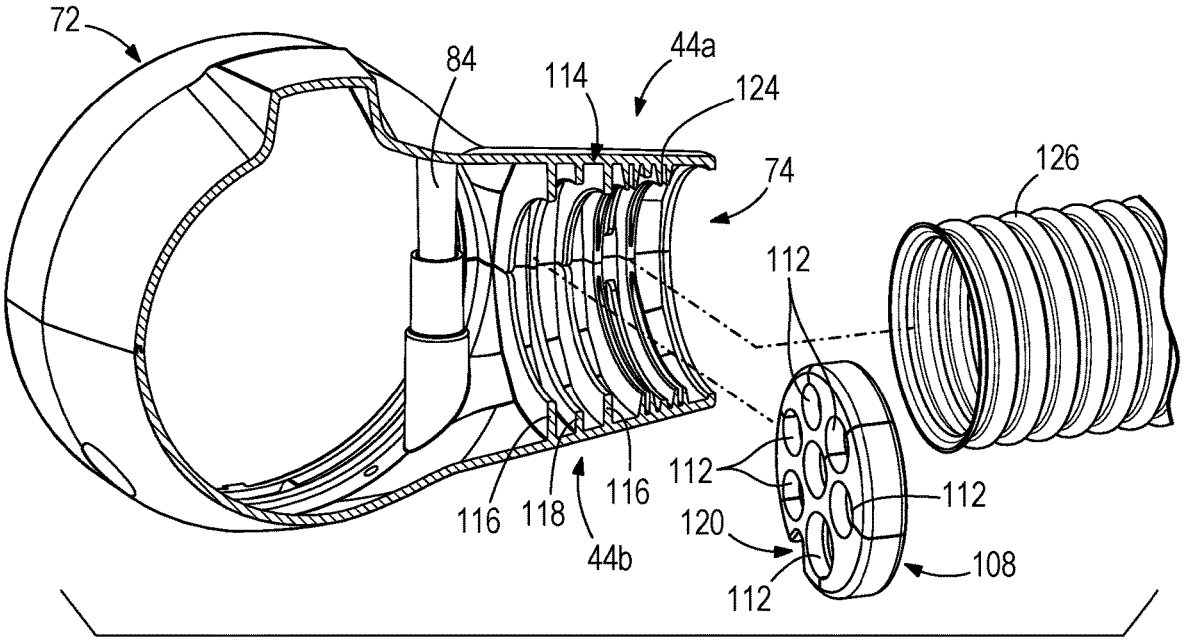
FIG. 4 is an exploded section view of the rigging device.
Figure 6:
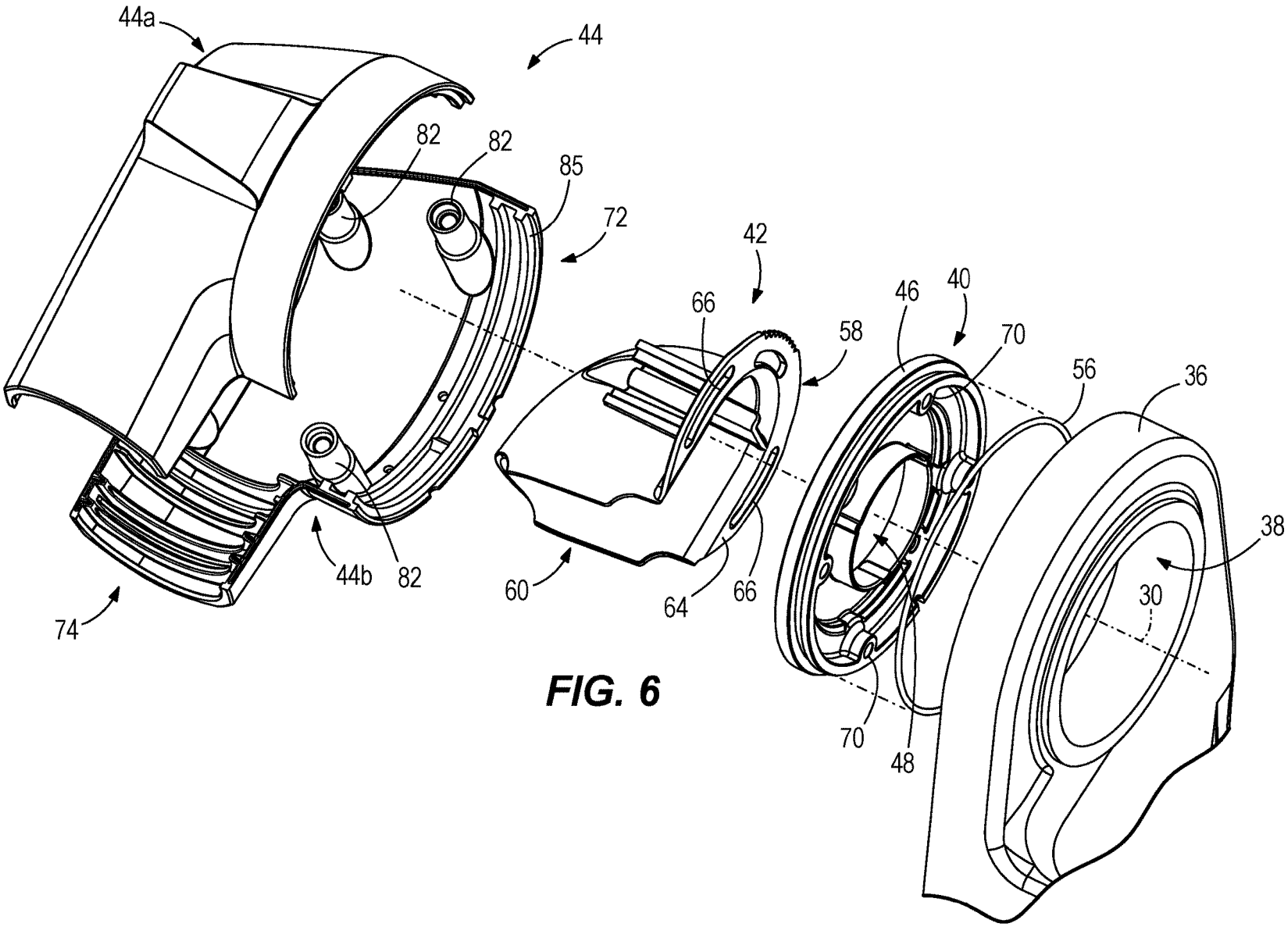
FIG. 6 is another exploded view of internal portions of the rigging device and a clamshell portion of the cover of the rigging device along with a portion of the transom bracket.

The elbow cover 44 is mounted on the base plate 40 and encloses the elbow conduit 42. Referring to FIGS. 3 and 4, the elbow cover 44 has an inlet end 72 that faces the rigging opening 38 and is concentric with the inlet end 58 of the elbow conduit 42, and an outlet end 74 that generally faces the marine vessel and is concentric with the outlet end 60 of the elbow conduit 42. The inlet end 72 and outlet end 74 are transversely oriented relative to each other and in the illustrated embodiment are oriented at ninety degrees relative to each other, parallel to and concentric with the inlet end 58 and outlet end 60 of the elbow conduit 42, respectively. The elbow cover 44 has upper and lower clamshell halves 44*a*, 44*b* which together enclose the elbow conduit 42. Referring to FIGS. 3 and 6, the upper and lower clamshell halves 44*a*, 44*b* are fastened together by fasteners 80 which extend through bosses 82 in the lower clamshell half 44*b* and into threaded engagement with bosses 84 on the upper clamshell half 44*a*. The bosses 82 and 84 have differently sized inner and outer diameters so that the bosses 82, 84 nest together in a male-female connection fit when the clamshell halves 44*a*, 44*b* are fastened together, as shown. As shown in FIG. 6, the inlet end 72 has an internal groove 85 that engages the outer diameter 46 of the base plate 40 when the clamshell halves 44*a*, 44*b* are fastened together, thus affixing the elbow cover 44 to the base plate 40 when the fasteners 80 are tightened. Optionally, a rubber ring seal (not shown) is disposed in the groove 85 between the upper and lower clamshell halves 44*a*, 44*b* and the base plate 40 and configured to prevent ingress of water.

A switch 86 facilitates manual actuation of a conventional trim actuator 88 (see FIG. 1) for trimming the outboard motor 16 about the trim axis 30, and is advantageously located on the rigging device 32. A switch 86 has a manually actuated toggle button 89 supported within a switch housing 90. The switch housing 90 is mounted to an adapter 92 by fasteners 94 and the adapter 92 is in turn mounted to the elbow conduit 42 via mounting flanges 96 on the outer top surface of the inlet end 58 of the elbow conduit 42, and via a fastener 98 that engages in threaded connection with a threaded boss 100 on the elbow conduit 42. The switch 86 could alternately be connected to the rigging device 32 by other conventional means. The switch 86 is manually accessible via an aperture 102 in the upper clamshell half 44*a* of the elbow cover 44 and is efficiently located on the rigging device 32 so that an operator standing in the marine vessel 12 can manually actuate the switch 86 and trim the outboard motor 16 up and down relative to the marine vessel 12. The switch 86 is also efficiently located so that when the marine vessel 12 is trailered, an operator standing alongside the outboard motor 16 can manually actuate the switch 86 and trim the outboard motor 16 up and down relative to the marine vessel 12. The switch 86 is electrically connected to the trim actuator 88 by electrical wires 104 that extend from the switch 86 through an aperture 106 in the elbow conduit 42. A rubber seal or other conventional sealing means can be used to seal the interface between the switch 86 and the elbow cover 44 in order to limit ingress of water. The trim actuator 88 can include any conventional fuel and/or electric device for trimming the outboard motor 16, examples of which are disclosed in the presently-incorporated U.S. Pat. No. 9,944,375, among others. Optionally, the switch 86 can be configured to actuate other operational features of the outboard motor 16, in addition to or instead of trim, for example steering, speed (e.g. fine adjustment speed or troll control), lights, and/or any other similar feature. In other examples, a data interface, shown schematically at reference character 45 in FIG. 2, can be located on the rigging device 32 and provide information to the operator regarding the outboard motor 16. Optionally the data interface can include lights, and/or a touch screen, and/or a plurality of switches, and/or any other conventional means for inputting operational commands to the outboard motor 16 and/or displaying operational characteristics of the outboard motor 16 to a user. Optionally, the interface 45 can include an electrical power source, for example a plug, and/or an electronic data port, for example a USB connector and/or the like that facilitates diagnostics of the outboard motor 16.

Figure 5:
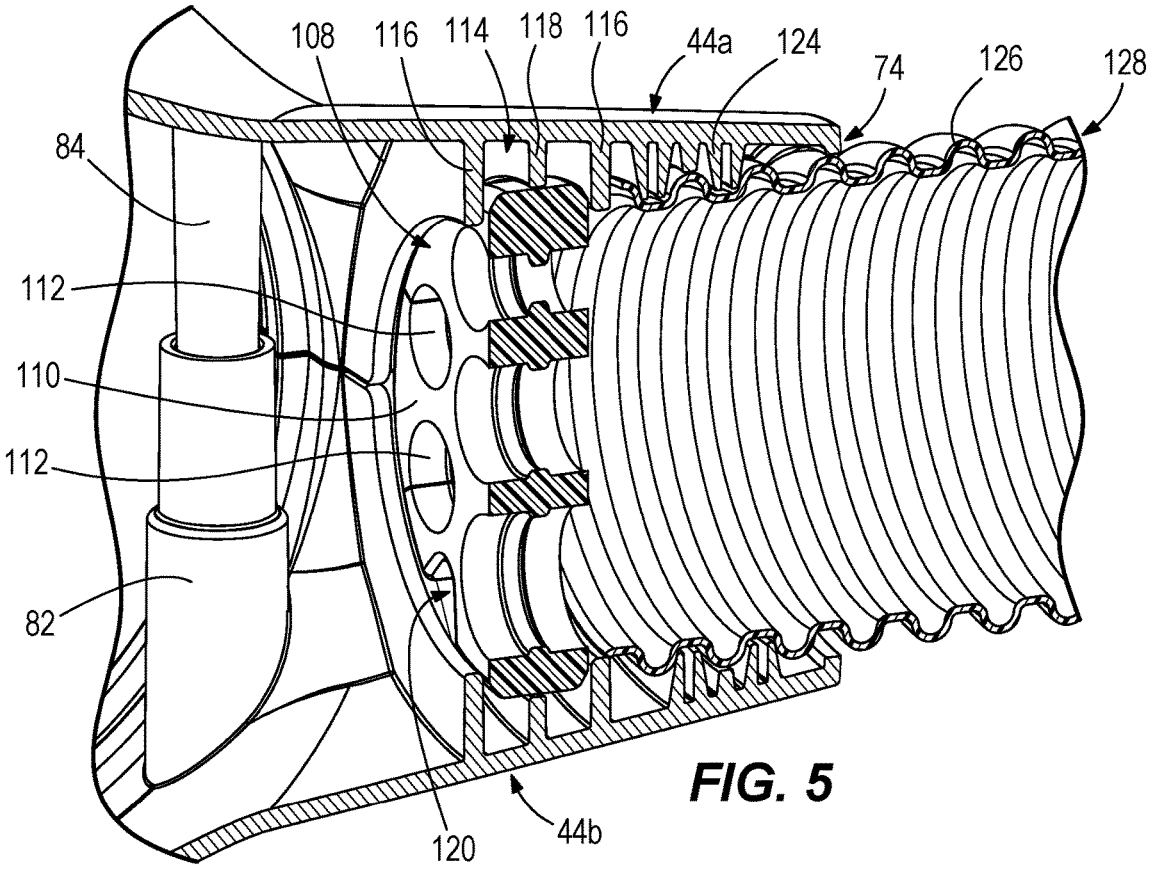
FIG. 5 is a section view of internal portions of the rigging device.

Referring to FIGS. 4 and 5, a novel guide member 108 is located at the outlet end 60 of the elbow cover 44 and is configured to properly orient the rigging members 34 relative to each other and relative to the inner diameter of the rigging device 32 and marine vessel 12. In the illustrated example, the guide member 108 includes a generally circular disc 110 having a plurality of separate axial pathways 112 extending there through, which are each configured to receive and radially separate and position the rigging members 34 relative to each other and relative to the internal diameter of the outlet end 60 of the elbow cover 44. The disc 110 is seated within a groove 114 formed between a pair of outer ribs 116 that extend radially inwardly from the inner diameter of the outlet end 60. The disc 110 is seated on an inner rib 118 that extends radially inwardly from the inner diameter, between the pair of outer ribs 116, but is shorter than the outer ribs 116. The guide member 108 may be made of rubber or other appropriate elastomeric material for providing a seal to limit the ingress of water, particularly via a press fit engagement between the relatively rigid inner rib 118 and relatively elastic outer diameter of the guide member 108. During installation, the guide member 108 is automatically rotationally positioned within the groove 114 between the pair of outer ribs 116 by a clocking feature, which in the illustrated example includes a radially outer recess 120 in the disc 110, which receives a protrusion 122 extending radially into the groove between the pair of outer ribs 116. This facilitates proper rotational orientation of the guide member 108 so that the desired orientation of the pathways 112 and associated rigging members 34 is achieved. The diameters of the pathways 112 may be sized differently relative to each other so as to accommodate the different diameters of the rigging members 34.

The inside diameter of the elbow cover 42 has a series of helical grooves 124 located laterally between the pair of outer ribs 116 and the outlet end 60. As shown in FIG. 5, the helical grooves 124 engage with and retain the outer ridges 126 of a corrugated member 128, which encloses the rigging members 34 from the rigging device 32 to the marine vessel 12. The corrugated member 128 can be made of any suitable material, as either a flexible or hard plumbing, and could be integrated with the transom of marine vessel. Such rigging members are connected to the marine vessel 12 by connections that are known in the art, for instance, by way to of those connections disclosed in U.S. Pat. No. 10,017,136.

Referring to FIGS. 7-10, the rigging device 32 has novel features that advantageously facilitate proper installation during rigging setup of the outboard motor 16 on the marine vessel 12.

Figure 7:
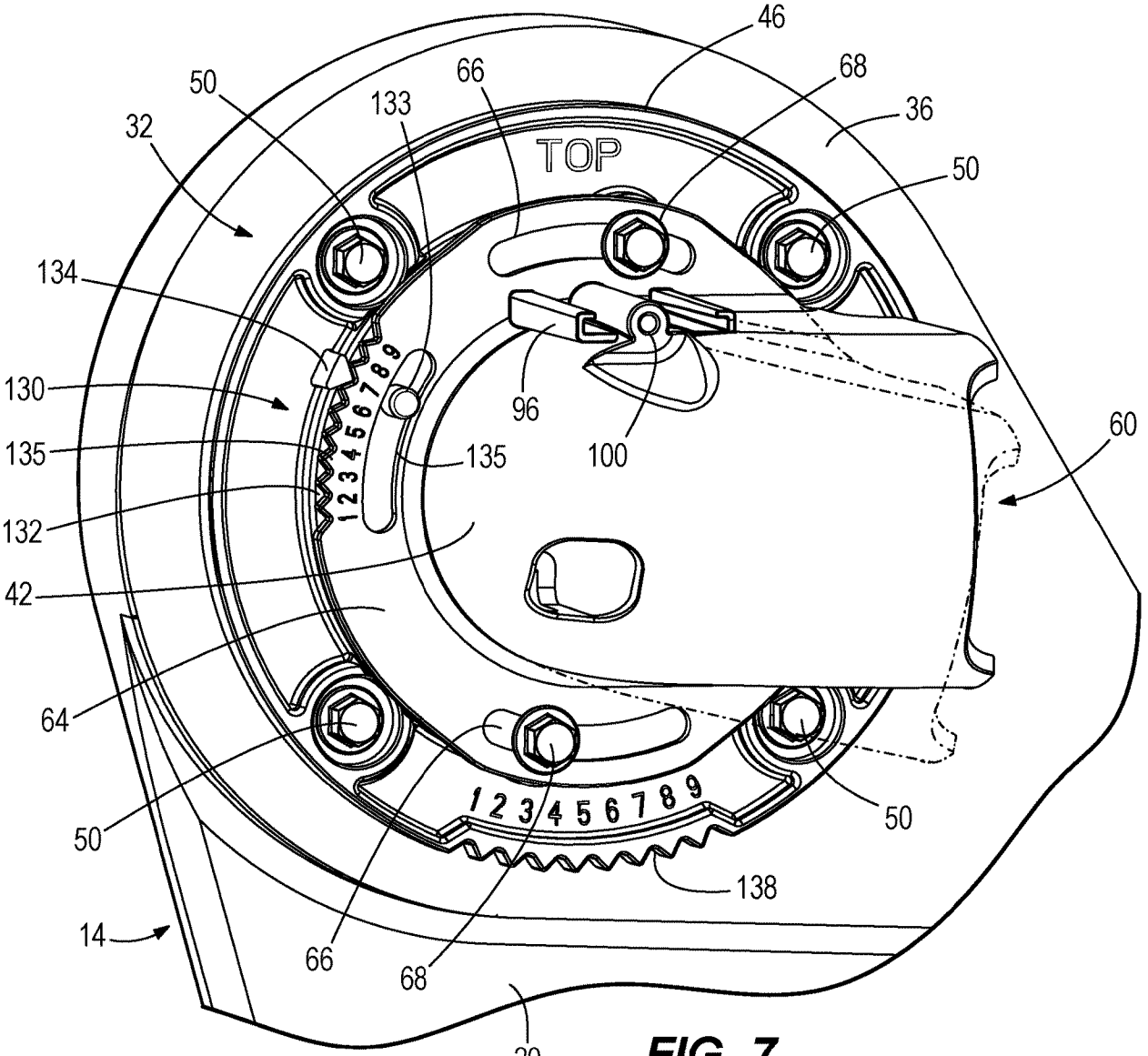
FIG. 7 is a side view of the rigging device and transom bracket, showing clocking movement of internal portions of the rigging device in dashed lines.

To install the rigging device 32, the installer first rigidly connects the base plate 40 to the ear 36 via the fasteners 50, as described herein above. Next the installer connects the elbow conduit 42 to the base plate 40. A first alignment mechanism 130 facilitates rotational alignment and positioning of the inlet end 58 of the elbow conduit 42 relative to the base plate 40 and thus relative to the rigging opening 38. In particular, the first alignment mechanism 130 permits the installer to choose between and position the elbow conduit 42 in a plurality of clock positions, wherein in each clock position the outlet end 60 of the elbow conduit 42 extends at a different angle relative to the top surface of the base plate 40, similar to different positions of a hand on a clock. In the illustrated example, the first alignment mechanism 130 includes a plurality of grooves 132 on the outer diameter of the radial flange 64 and a corresponding engagement member 134 on the base plate 40 that registers with each groove in the plurality of grooves 132. During installation, the installer manually centers the inlet end 58 of the elbow conduit 42 with respect to the rigging opening 38 and lowers the inlet end 58 towards the base plate 40. Next, the installer inserts the fasteners 68 through the slots 66 and into only an initial threaded engagement with corresponding bores 70 in the base plate 40, i.e., without clamping the heads onto the top of the radial flange 64. In this position, slots 66 allow the installer to manually rotate the elbow conduit 42 until the outlet end 60 is in a desired clock position. A post 133 on the base plate 140 is located in a slot 135 in the radial flange 64 and guides the manual rotational movement of the radial flange 64 relative to the base plate 40. Each groove 132 registers with the engagement member 134 at a different respective clock position. Once the desired clock position of the elbow conduit 42 is set, in particular via registration of the engagement member 134 with the appropriate groove 132, the installer completes installation of the elbow conduit 42 by further tightening the fasteners 68 into the bores 70 until the heads clamp down onto the top of the radial flange 64. As shown in FIG. 7, a first group of numerical indicia 135 is provided on the radial flange 64, one number for each groove 132.

Figure 8:
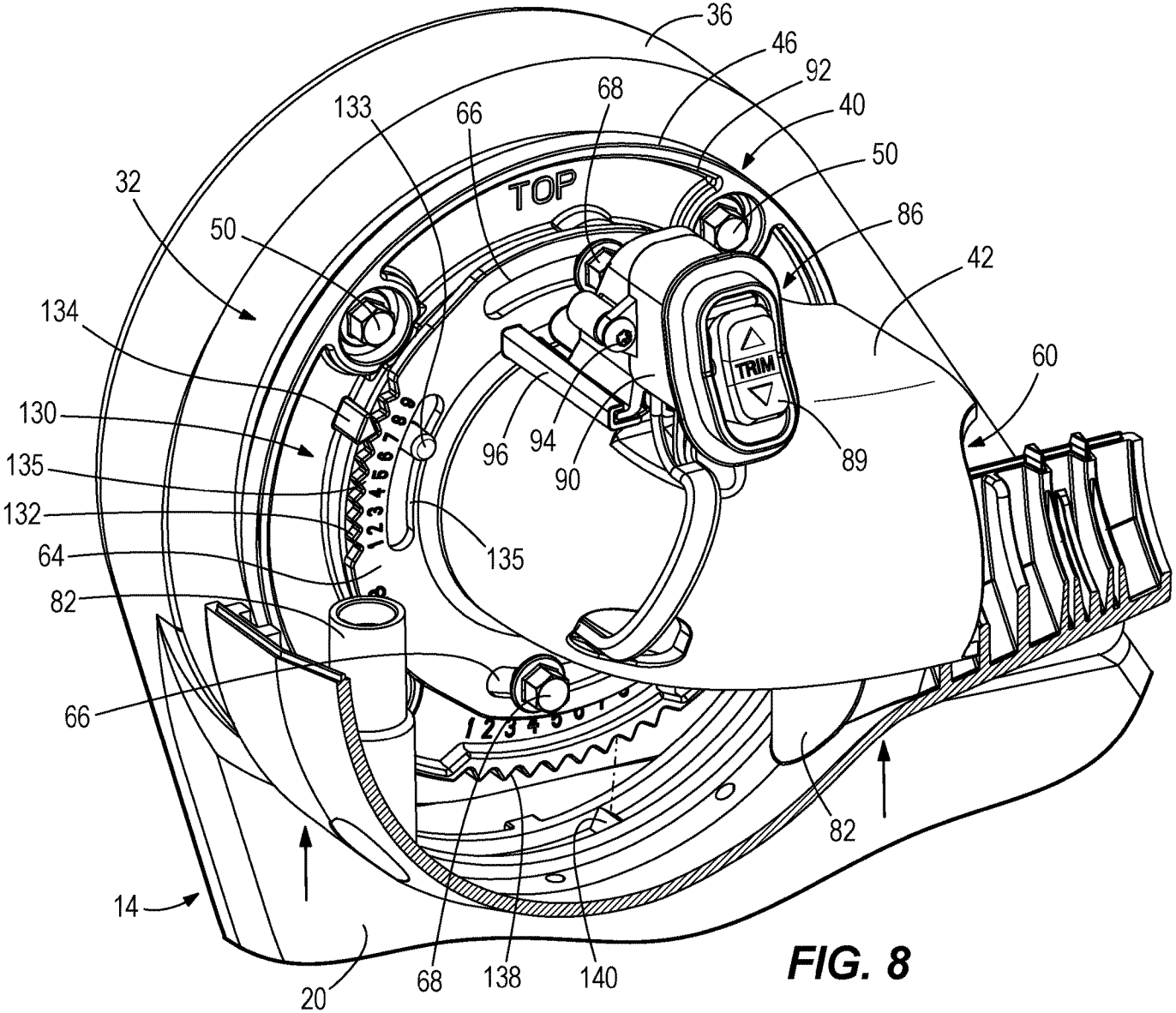
FIG. 8 is a perspective view of internal portions of the rigging device along with a portion of the transom bracket and a section of a lower clamshell portion.
Figure 9:
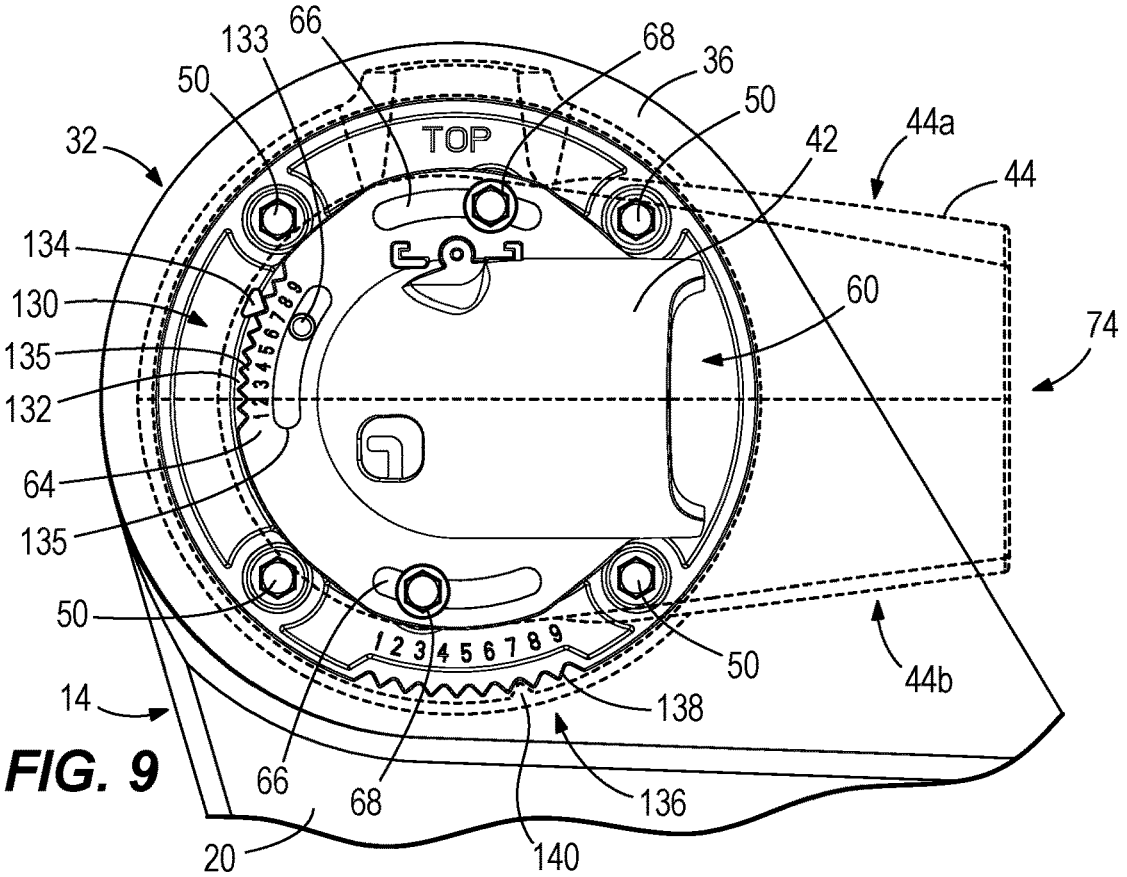
FIGS. 9 and 10 are side views of the rigging device and transom bracket, showing clocking movement of the rigging device, including internal portions of the rigging device in solid lines and cover portions of the rigging device in dashed lines.
Figure 10:
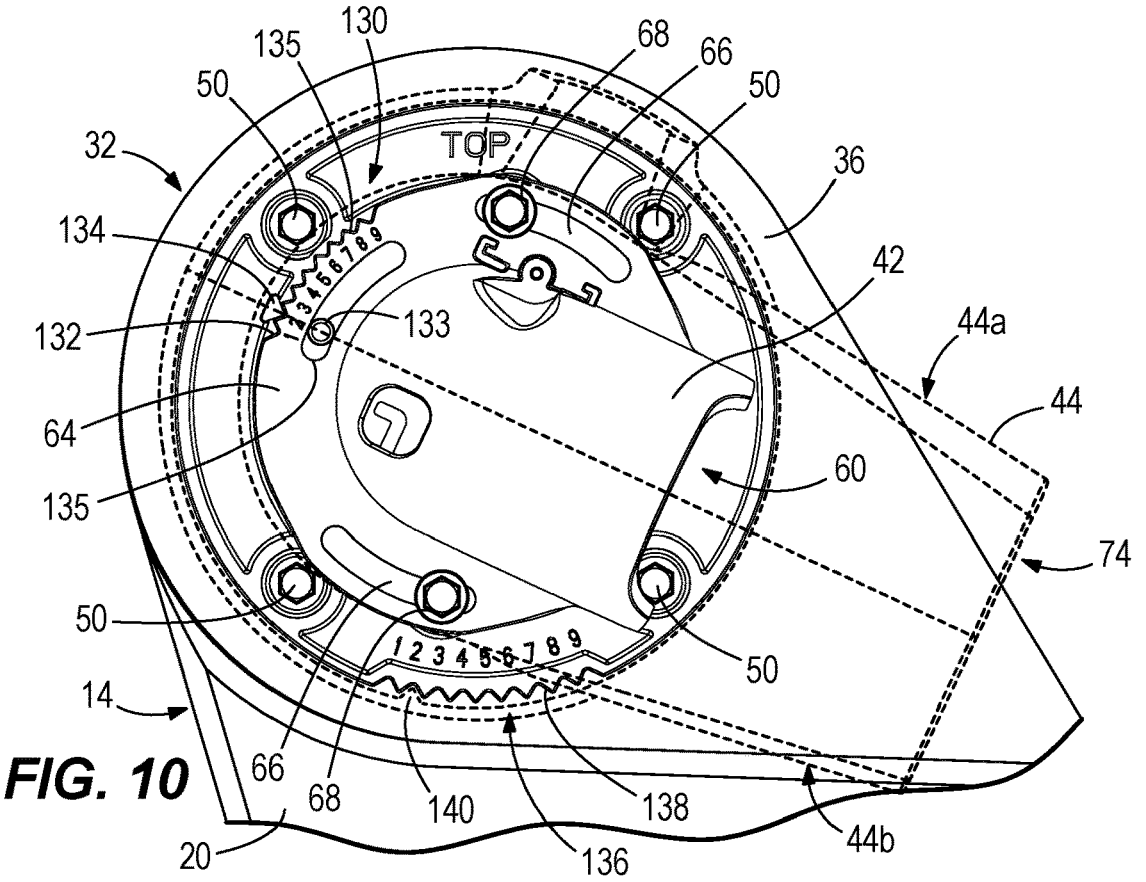

Once the elbow conduit 42 is installed, as shown in FIG. 7, the installer can install the switch 86, as described herein above and shown in FIG. 8.

Next, the installer installs the elbow cover 44, guide member 108 and associated rigging members 34. As explained herein above, the elbow cover 44 has upper and lower clamshell halves **44*a*, 44*b* that together enclose the elbow conduit 42. Advantageously, the rigging device 32 has a second alignment mechanism 136, which facilitates rotational alignment and positioning of the inlet end 72 and outlet end 74 of the elbow cover 44 with the inlet end 58 and outlet end 60 of the elbow conduit 42, and relative to the rigging opening 38. In particular, the second alignment mechanism 136 permits the installer to choose between and position the elbow cover 44 in a plurality of clock positions, wherein in each clock position the outlet end 74 of the elbow cover 44 extends at a different angle relative to the top surface of the base plate 40**, similar to different positions of a hand on a clock.

In the illustrated example, the second alignment mechanism 136 includes a plurality of grooves 138 on the outer diameter of the base plate 40 and a corresponding engagement member 140 on the inner diameter of the inlet end 72 of the lower clamshell half **44*b* of the elbow cover 44, which registers with each groove in the plurality of grooves 138 at a different respective clock position of the lower clamshell half 44*b*. A second group of numerical indicia 142 that is the same as the first group of numerical indicia 135 is located on the base plate 40 adjacent to the plurality of grooves 138. During installation, the installer manually brings the lower clamshell half 44*b* onto the outer diameter of the base plate 40, such that the outlet end 74 of the elbow cover 44 is generally aligned with and concentric on the outlet end 60 of the elbow conduit 42 and more particularly so that the engagement member 140 is seated in the groove 138 having the same numerical indicia as the numerical indicia of the groove 132 in which the engagement member 134 is seated. When the engagement members 134 and 140 are seated in grooves 132, 138 having the same numerical indicia as each other, the installer know that the elbow conduit 42 and elbow cover 44 are concentric and aligned. Next the installer inserts the guide member 108 into the groove 114 and rotationally positions the guide member 108 until the noted clocking feature accommodates proper seating of the guide member 108 in the groove 114. Before or after insertion of the guide member 108, the installer inserts the rigging members 34 through the pathways 112 and nests the corrugated member 128 in the helical grooves 124. Finally, the installer lowers the upper clamshell half 44***a* onto the outer diameter of the base plate 40 and fastens the upper clamshell half 44*a* to the lower clamshell half 44*b* via fasteners.

Thus, it will be seen that the present disclosure provides a novel rigging apparatus including a rigging device for operationally coupling a marine drive to a marine vessel. According to the present disclosure, the present inventors have realized that, especially in embodiments of marine drives that maintain a fixed steering position relative to the transom bracket, it is desirable to provide rigging apparatuses that facilitate multiple orientations or positions, including angular and lateral positions, of rigging members spanning a junction between the marine drive and the marine vessel. This advantageously would allow one configuration of rigging device to be used with a variety of marine vessel designs and common rigging hardware. The inventors further realized it is desirable to provide such an arrangement wherein the attitude of the rigging elbow and rigging hose can be adjusted and able to be installed at an optimum position, depending upon the specific marine vessel configuration, particularly the transom configuration. Advantageously, the presently disclosed embodiments provide nine predefined positions for the rigging elbow, which allow for five degree incremental changes for a total of forty-five degrees of adjustment. Location of the rigging device on the transom bracket and particularly along the trim axis allows the marine drive to be trimmed relative to the transom bracket and marine vessel without an effect on the attitude of the rigging elbow and associated rigging hose. These items advantageously remain in their originally installed positions. The present embodiments advantageously enable seamless integration between marine vessel and marine drive, with hidden and unobtrusive routing of fuel lines, electronics, and control system hardware.

It will thus be realized that the present disclosure provides:

An apparatus for operably connecting a marine drive to a marine vessel, the apparatus comprising a transom bracket configured for fixed attachment to the marine vessel and configured for attachment to the marine drive such that the marine drive is trimmable up and down about a trim axis, wherein the transom bracket comprises a sidewall with a rigging opening through which at least one elongated rigging member extends for operably connecting the marine drive to the marine vessel, and wherein the rigging opening is located along the trim axis.

In certain examples, the elongated rigging member comprises at least one of an electrical wire and a fuel conduit. The apparatus comprises a rigging device on the transom bracket, the rigging device being configured to route the elongated rigging member from the rigging opening towards the marine vessel. The rigging device is positionable into a plurality of clock positions relative to the rigging opening and the plurality of clock positions spans at least forty-five degrees. The rigging device comprises an elbow conduit having an inlet end facing the opening and an outlet end oriented towards the marine vessel, and further comprises an elbow cover on the elbow conduit. A switch is on the rigging device, the switch being configured for electrical connections to a trim actuator for trimming the marine drive up and down about the trim axis relative to the transom bracket and the marine vessel. The switch is mounted on the elbow conduit and is manually accessible via an aperture in the elbow cover.

In certain examples, the elbow cover has an outlet that is concentric with the outlet end of the elbow conduit. A guide member is disposed along the outlet of the elbow cover. The guide member provides a plurality of pathways for radially separating and guiding the plurality of elongated rigging members through the outlet. In certain examples, the guide member comprises a disc that is nested in a pair of grooves formed on an inner diameter of the outlet of the elbow cover. The disc comprises a clocking feature that engages with a corresponding clocking feature on the elbow cover to automatically clock the guide member in a preferred orientation during installation. A series of grooves are on the inner diameter of the outlet of the elbow cover, the series of grooves configured to engage with and retain a corrugated member that conveys the plurality of elongated rigging members from the rigging device to the marine vessel.

In certain examples, the rigging device comprises a first indicia that indicates a current clocked position of the elbow conduit and a second indicia that indicates a current clocked position of the elbow cover. A first alignment mechanism is for rotationally aligning and positioning the elbow conduit in each of the plurality of clocked positions and a second alignment mechanism for rotationally aligning and positioning the elbow cover in each of the plurality of clocked positions. The first alignment mechanism comprises a first plurality of grooves on the elbow conduit and an engagement member alongside the rigging opening, and the second alignment mechanism comprises a second plurality of grooves on the base plate and an engagement member on the elbow cover. The first indicia are alongside the first plurality of grooves and the second indicia are located along the second plurality of grooves. The elbow conduit has a radial flange having at least one elongated slot in which a fastener extends for fastening the elbow conduit to the transom bracket, wherein loosening the fastener permits rotation of the elbow conduit into each of the plurality of clocked positions and wherein tightening the fastener retains the elbow conduit in place.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims.

What is claimed is:

1. An apparatus for operably connecting a marine drive to a marine vessel, the apparatus comprising a transom bracket configured for fixed attachment to the marine vessel and for attachment to the marine drive such that the marine drive is trimmable up and down relative to the marine vessel about a trim axis, wherein the transom bracket comprises a sidewall with a rigging opening through which at least one elongated rigging member extends for operably connecting the marine drive to the marine vessel, and wherein the rigging opening is located along the trim axis.

2. The apparatus according to claim 1, wherein the elongated rigging member comprises at least one of an electrical wire and a fluid conduit.

3. The apparatus according to claim 1, further comprising a rigging device on the transom bracket, the rigging device configured to route the elongated rigging member from the rigging opening towards the marine vessel.

4. The apparatus according to claim 3, wherein the rigging device is positionable into a plurality of clock positions relative to the rigging opening.

5. The apparatus according to claim 4, wherein the rigging device comprises an elbow conduit having an inlet end facing the rigging opening and an outlet end oriented towards the marine vessel.

6. The apparatus according to claim 5, further comprising a cover on the elbow conduit.

7. The apparatus according to claim 3, further comprising a switch on the rigging device, the switch being configured for electrical connection to a trim actuator for trimming the marine drive about the trim axis.

8. The apparatus according to claim 6, wherein the cover has an outlet that is concentric with the outlet end of the elbow conduit.

9. The apparatus according to claim 8, wherein the elongated rigging member is one of a plurality of elongated rigging members, and further comprising a guide member providing a plurality of pathways for radially separating the plurality of elongated rigging members in the rigging device.

10. The apparatus according to claim 9, wherein the guide member comprises a disc that is nested in at least one groove in an inner diameter of the cover.

11. The apparatus according to claim 6, wherein both the elbow conduit and the cover are separately positionable in each of the plurality of clock positions.

12. The apparatus according to claim 11, wherein the rigging device comprises a first indicia which indicates a current clock position of the elbow conduit and a second indicia which indicates a current clock position of the cover.

13. The apparatus according to claim 12, further comprising a first alignment mechanism for rotationally aligning the elbow conduit in each of the plurality of clocked positions and a second alignment mechanism for rotationally aligning the cover in each of the plurality of clocked positions.

14. The apparatus according to claim 13, wherein the rigging device further comprises a base plate on the rigging opening, wherein the first alignment mechanism comprises a first plurality of grooves on the elbow conduit and an engagement member alongside the rigging opening, and wherein the second alignment mechanism comprises a second plurality of grooves on the base plate and an engagement member on the cover.

15. The apparatus according to claim 14, wherein the first indicia are alongside the first plurality of grooves and the second indicia are located along the second plurality of grooves.

16. The apparatus according to claim 11, wherein the elbow conduit has a radial flange having at least one elongated slot in which a fastener extends for fastening the elbow conduit to the transom bracket, wherein loosening the fastener permits rotation of the elbow conduit into each of the plurality of clocked positions and wherein tightening the fastener retains the elbow conduit in place.

17. A rigging device for routing at least one elongated rigging member from a marine drive to a marine vessel, the rigging device comprising a base plate having a center opening for receiving the at least one rigging member and further having an elbow conduit coupled to the base plate, wherein the elbow conduit has an inlet end facing the center opening and receiving the at least one rigging member and an outlet end extending transversely relative to the inlet end for directing the at least one rigging member to the marine vessel, wherein the elbow conduit is selectively fixable in a predefined plurality of clock positions relative to the base plate, and further wherein in each clock position the outlet end of the elbow conduit extends at a different respective angle relative to the base plate.

18. The rigging device according to claim 17, further comprising a cover on the elbow conduit.

19. A rigging device for routing at least one elongated rigging member from a marine drive to a marine vessel, the rigging device comprising an elbow conduit having an inlet end and an outlet end, wherein the outlet end is positionable into a plurality of clock positions relative to the inlet end, and wherein the inlet end is configured to face a rigging opening and the outlet end is configured to be oriented towards the marine vessel, and further comprising a switch on the rigging device, the switch being configured for electrical connection to a trim actuator for trimming the marine drive up and down relative to the marine vessel.

20. The rigging device according to claim 19, further comprising a cover on the elbow conduit, wherein the cover has an outlet which is concentric with the outlet end of the elbow conduit.

21. A rigging device for routing at least one elongated rigging member from a marine drive to a marine vessel, the rigging device comprising an elbow conduit having an inlet end and an outlet end, wherein the outlet end is positionable into a plurality of clock positions relative to the inlet end, and wherein the inlet end is configured to face a rigging opening and the outlet end is configured to be oriented towards the marine vessel, and further comprising a cover on the elbow conduit, wherein the cover has an outlet that is concentric with the outlet end of the elbow conduit, and wherein the elongated rigging member is one of a plurality of elongated rigging members, and further comprising a guide member providing a plurality of pathways for radially separating the plurality of elongated rigging members within the elbow conduit.

22. The rigging device according to claim 21, wherein the guide member comprises a disc which is nested in at least one groove formed in the cover.

23. The rigging device according to claim 19, wherein both the elbow conduit and cover are separately positionable in each of the plurality of clock positions.

24. A rigging device for routing at least one elongated rigging member from a marine drive to a marine vessel, the rigging device comprising an elbow conduit having an inlet end and an outlet end, wherein the outlet end is positionable into a plurality of clock positions relative to the inlet end, and wherein the inlet end is configured to face a rigging opening and the outlet end is configured to be oriented towards the marine vessel, a cover on the elbow conduit, wherein both of the elbow conduit and the cover are separately positionable in each one of the plurality of clock positions, wherein the rigging device comprises a first indicia which indicates a current clocked position of the elbow conduit and a second indicia which indicates a current clocked position of the cover.

25. The rigging device according to claim 24, further comprising a first alignment mechanism for rotationally aligning the elbow conduit in each of the plurality of clocked positions and a second alignment mechanism for rotationally aligning the cover in each of the plurality of clocked positions.

26. The rigging device according to claim 25, wherein the rigging device further comprises a base plate on the rigging opening, and wherein the first alignment mechanism comprises a first plurality of grooves on the elbow conduit and an engagement member alongside the rigging opening, and wherein the second alignment mechanism comprises a second plurality of grooves on the base plate and an engagement member on the cover.

27. The rigging device according to claim 26, wherein the first indicia are alongside the first plurality of grooves and the second indicia are located along the second plurality of grooves.

28. A rigging device for routing at least one elongated rigging member from a marine drive to a marine vessel, the rigging device comprising an elbow conduit having an inlet end and an outlet end, wherein the outlet end is positionable into a plurality of clock positions relative to the inlet end, w and wherein the inlet end is configured to face a rigging opening and the outlet end is configured to be oriented towards the marine vessel, a cover on the elbow conduit, wherein both of the elbow conduit and the cover are separately positionable in each one of the plurality of clock positions, wherein the elbow conduit has a radial flange having at least one elongated slot in which a fastener extends for fastening the elbow conduit to the transom bracket, wherein loosening the fastener permits rotation of the elbow conduit into each of the plurality of clocked positions and wherein tightening the fastener retains the elbow conduit in place.

29. A rigging device for routing at least one elongated rigging member from a marine drive to a marine vessel, the rigging device comprising an elbow conduit having an inlet end and an outlet end, wherein the outlet end is positionable relative to the inlet end, and further comprising a user interface on the rigging device, the user interface facilitating input or output of at least one operational characteristic of the marine drive.

30. The rigging device according to claim 29, wherein the user interface is configured to display diagnostics of the marine drive.

31. The rigging device according to claim 30, wherein the user interface is configured to input an operator command to the marine vessel.

32. The apparatus according to claim 7, wherein the rigging device comprises an elbow conduit, and wherein the switch is mounted on the elbow conduit.

33. The apparatus according to claim 10, wherein the disc comprises a clocking feature that engages with a corresponding clocking feature on the cover to automatically clock the guide member in a preferred orientation during installation.

34. The apparatus according to claim 10, further comprising a series of grooves on the inner diameter of the outlet of the cover, the series of grooves configured to engage with and retain a corrugated member that conveys the plurality of elongated rigging members from the rigging device to the marine vessel.

35. The apparatus according to claim 16, wherein the rigging device further comprises a base plate on the rigging opening, and wherein the elbow conduit and the cover are mounted on the base plate.

36. The apparatus according to claim 35, wherein the fastener is engaged with a threaded bore in the base plate to thereby fasten the elbow conduit to the rigging opening.

37. The apparatus according to claim 35, wherein the cover is clamped onto a radially outer end of the base plate.

38. The rigging device according to claim 17, wherein the plurality of clock positions spans at least forty-five degrees relative to a trim axis.

39. A rigging device for routing at least one elongated rigging member from a marine drive to a marine vessel, the rigging device comprising a base plate and an elbow conduit coupled to the base plate, wherein the elbow conduit is positionable into a plurality of clock positions relative to the base plate, and further comprising a switch on the rigging device, the switch being configured for electrical connection to a trim actuator for trimming the marine drive about the trim axis.

40. The rigging device according to claim 19, wherein the switch is mounted on the elbow conduit.

41. The rigging device according to claim 22, wherein the disc comprises a clocking feature which engages with a corresponding clocking feature on the cover to automatically clock the guide member in a preferred orientation during installation.

42. The rigging device according to claim 22, further comprising a series of grooves on the cover, the series of grooves being configured to engage with and retain a corrugated member that conveys the plurality of elongated rigging members from the rigging device to the marine vessel.

43. The rigging device according to claim 28, wherein the rigging device further comprises a base plate extending around the rigging opening, and wherein the elbow conduit and the cover are mounted on the base plate.

44. The rigging device according to claim 43, wherein the fastener is engaged with a threaded bore in the base plate to thereby fasten the elbow conduit to the rigging opening.

45. The rigging device according to claim 44, wherein the cover is clamped onto a radially outer end of the base plate.

46. The apparatus according to claim 16, wherein the rigging device further comprises a base plate on the rigging opening, and wherein the elbow conduit and the cover are on the base plate.

47. The apparatus according to claim 46, wherein the fastener is engaged with a threaded bore in the base plate to thereby fasten the elbow conduit to the rigging opening.

48. The apparatus according to claim 46, wherein the cover is clamped onto a radially outer end of the base plate.

49. The rigging device according to claim 19, wherein the switch is mounted on the elbow conduit.

* * * * *